United States Patent [19]

Greller

[11] 4,400,124

[45] Aug. 23, 1983

[54] DEVICE FOR HANDLING STACKS OF FLEXIBLE OBJECTS

[75] Inventor: Peter Greller, Enkenbach, Fed. Rep. of Germany

[73] Assignee: Pfaff Industriemaschinen GmbH, Fed. Rep. of Germany

[21] Appl. No.: 268,187

[22] Filed: May 29, 1981

[30] Foreign Application Priority Data

Jun. 27, 1980 [DE] Fed. Rep. of Germany ..... 3024112

[51] Int. Cl.[3] ..... B65H 29/38

[52] U.S. Cl. ..... 414/43; 294/67 BB; 271/209

[58] Field of Search ..... 414/28, 43; 294/67 BB, 294/67 BC, 67 DB, 67 B; 271/188, 209

[56] References Cited

U.S. PATENT DOCUMENTS

| | | | |
|---|---|---|---|
| 2,198,652 | 4/1940 | Cullen et al. | 294/67 BC |
| 2,735,713 | 2/1956 | Blakeley | 294/67 BB |
| 3,086,808 | 4/1963 | Kaplan | 294/67 BC |
| 3,655,232 | 4/1972 | Martelee | 294/67 BB |
| 3,761,080 | 9/1973 | Larson | 414/79 X |

FOREIGN PATENT DOCUMENTS

| | | | |
|---|---|---|---|
| 1481862 | 8/1969 | Fed. Rep. of Germany | 294/67 BC |
| 2017622 | 10/1979 | United Kingdom | 271/209 |

*Primary Examiner*—Robert J. Spar
*Assistant Examiner*—Ken Muncy
*Attorney, Agent, or Firm*—McGlew and Tuttle

[57] ABSTRACT

A device for handling a stack of flexible articles, such as magazines comprises a bearing plate for receiving the stack of articles which either has an arched central portion or a deflecting bar for holding a stack of articles thereon in an arched location with the ends lowered in the central portion. Associated with the bearing plate is a gripping mechanism which includes gripping arms which are mounted for movement toward and away from respective ends of the articles to be gripped. Each of the gripping arms includes a holding finger which may be rotated between a horizontal position in which the fingers will engage below each end of the articles or to a vertical position in which the articles are released. When the fingers engage horizontally below the ends of the articles the gripping mechanism may be lifted to lift the articles off the bearing plate. When the articles are transferred to a stacking station, the arms may be moved outwardly from the articles and the fingers move to a vertical position so that the articles will be dropped onto the stacking pile.

9 Claims, 4 Drawing Figures

DEVICE FOR HANDLING STACKS OF FLEXIBLE OBJECTS

FIELD AND BACKGROUND OF THE INVENTION

This invention relates in general to gripping devices for transferring articles and in particular to a new and useful gripping device for handling stacks of flexible objects such as magazines.

When handling stacks of magazines formed at the discharge end of printing presses difficulties develop inasmuch as the printing inks are, in part, still wet and can, therefore, smear. If it is intended to put stacks of freshly printed magazines from the printing press on a pallet with a continuous bearing surface and possibly deposit them in multiple layers, no devices can be used in which the stacks are supported by a continuous or interrupted, such as forkshaped, carrying plate because the carrying plate would have to be pulled out from under the stack in a horizontal direction at the pallet storage location. The still wet printing ink on the bottom page of the lowermost magazine would be smeared, at least in part, in this process. Moreover, individual pages could be pulled along by adhering to the carrying plate and thus become creased.

Known from DE-OS No. 24 49 674 is a device for gripping stacks of flat objects, in which the stacks are held on two opposite side surfaces by means of two clamping jaws which are movable towards each other. But this gripping principle is suitable only for firm, unbending objects such as tiles. Flexible objects such as magazines would sag downwardly due to their weight and slip out of the gripping device.

The technical problem underlying the invention is to provide a device for handling stacks of flexible objects such as magazines or single sheets, by means of which the stacks can be gripped securely and all objects comprising the stack are treated gently.

In accordance with the invention, a device for gripping a stack of flexible articles such as magazines comprises a bearing plate for receiving the stack of articles with deflecting means associated therewith for deflecting the center of the articles upwardly and into an arched position relative to each end. A gripping mechanism is associated with the bearing plate and includes gripping arms which are movable toward and away from their respective ends of the stacked articles. Each arm contains a holding finger which may be pivotal to a horizontal position to engage beneath each end of the articles for lifting them off the bearing plate or which may be moved to a vertical position for releasing the articles. Gripping arms are advantageously moved by a fluid pressure operated device to move them into engagement or out of engagement with the stack of articles and the holding fingers are advantageously moved by a separately control device which also may be fluid pressure operated.

The stack lying on the bearing plate is pre-arched upwardly by the stack forming element. When the stack is subsequently gripped by the gripping mechanism in that the clamping jaws move toward each other, the stack is compressed laterally and thereby arched even more in the direction predetermined by the pre-arching operation. This imparts to the individual objects of the stack such an ample stiffness as not to be able to bend through downwardly and fall out of the gripping device. In their working position, the holding fingers disposed at the lower end of the clamping jaws support the two lower edge areas of the stack, thereby forming an additional safety against the stack falling out of the gripping mechanism. They are particularly expedient whenever the stack is subjected to high vertical acceleration or deceleration forces when being moved from the bearing plate to a remote pallet.

Since the stack need be supported additionally in a vertical direction in its lower edge area only because of being arched and because of its inherent stiffness caused thereby, the holding fingers may be comparatively short. This limits the contact area between holding fingers and stack underside to a minimum from the start. Shortness of the holding fingers brings yet another advantage, namely that the gripping mechanism may assume a relatively low position over the pallet when depositing the stack so that the stacks are dropped only a short distance when released.

According to another feature of the invention the stack forming element is formed by a bar which can be raised beyond the top of the bearing plate. The bar, preferably disposed in a central slot in the bearing plate, is retracted so far in its rest position that its top is flush with the top of the bearing plate. The bar is raised only when the stack is completely formed.

If no flat bearing surface is required for the formation of the stack, the stack forming element may be formed by the arched top of the bearing plate so that the individual objects of the stack are pre-arched already when placed on the bearing plate or stack.

In another development of the invention, the holding fingers are pivotable about a horizontal axis and in their rest position are flush with the clamping surface of the clamping jaws. Therefore, since the holding fingers are not retracted in a horizontal plane, but swung outwardly and, hence, downwardly, there is no danger that the possibly still wet printing ink of freshly printed magazines becomes smeared on the bottom side of the lowermost magazine and/or that individual pages are partly pulled along and are creased in the process. Due to the fact that the holding fingers are flush in their rest position with the clamping surface of the clamping jaws, the clamping surface of each clamping jaw forms a selfcontained, flat surface without protrusions and depressions. This eliminates the danger of individual magazines or sheets adhering to the clamping jaws when picking up or depositing a stack.

Advantageous features of the gripping mechanism are described in additional subclaims, one special advantage consisting in that the gripping mechanism is adjustable to accommodate stacks of different widths.

Due to the measure of mounting the transmission elements serving to drive the holding fingers in recesses in the clamping jaws, no additional space is needed for the accommodation of these transmission elements, which would otherwise either decrease the usable space between the clamping jaws or enlarge the outside dimensions and, hence, the space requirement of the gripping mechanism. The compact design permits depositing the stacks with comparatively narrow gaps.

Accordingly, it is an object of the invention to provide an improved device for lifting flexible articles which includes means for positioning the articles in an arched position so that a stack of the articles become reinforced so that the ends may be subsequently engaged by a gripping mechanism and lifted upwardly.

A further object of the invention is to provide a gripping device which includes gripping arms which are movable toward and away from articles which are arranged in an arched stack or deflected into an arched stack and which includes engagement fingers which are pivotal and which may be moved to horizontal positions so as to engage in recesses of the bearing plate on which the articles are stacked and lift them upwardly.

A further object of the invention is to provide a gripping device for engaging flexible artices which is simple in design rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
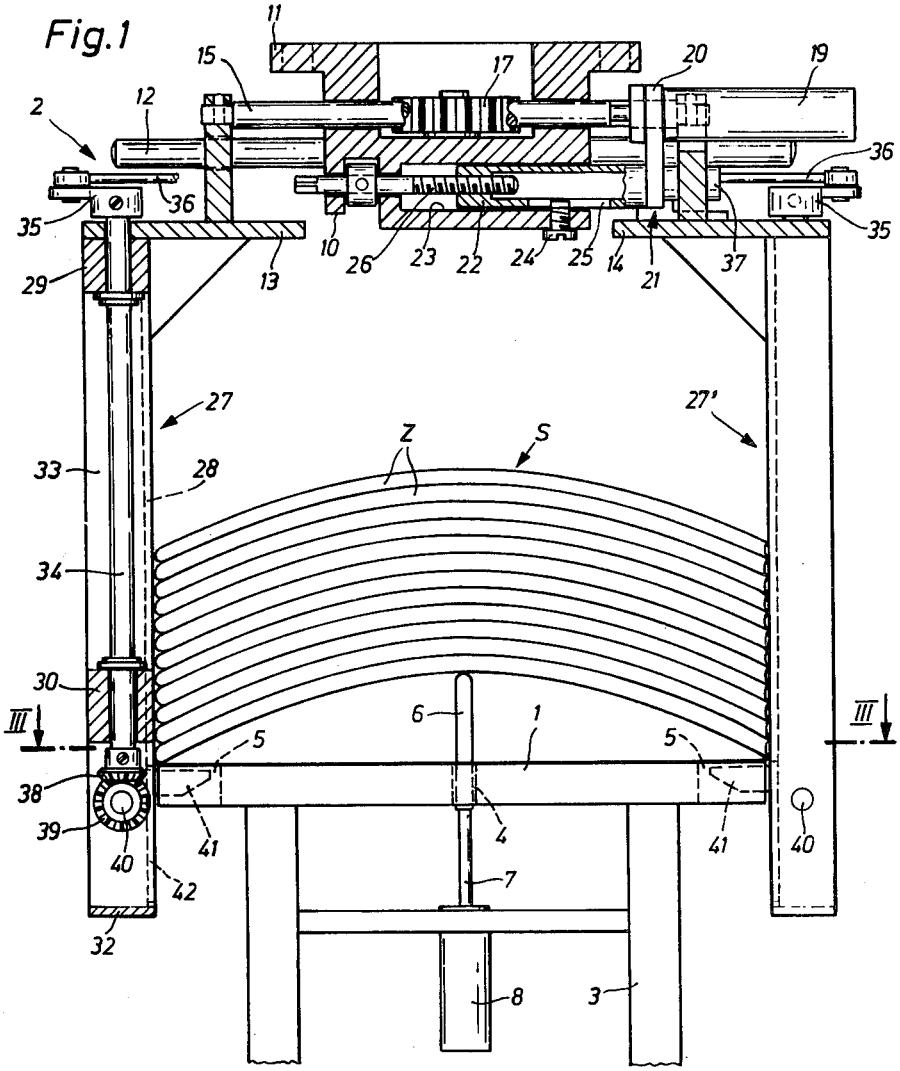
FIG. 1 is a partial elevation and partial sectional view of a gripping mechanism constructed in accordance with the invention taken along the line I—I of FIG. 2.
Figure 4:
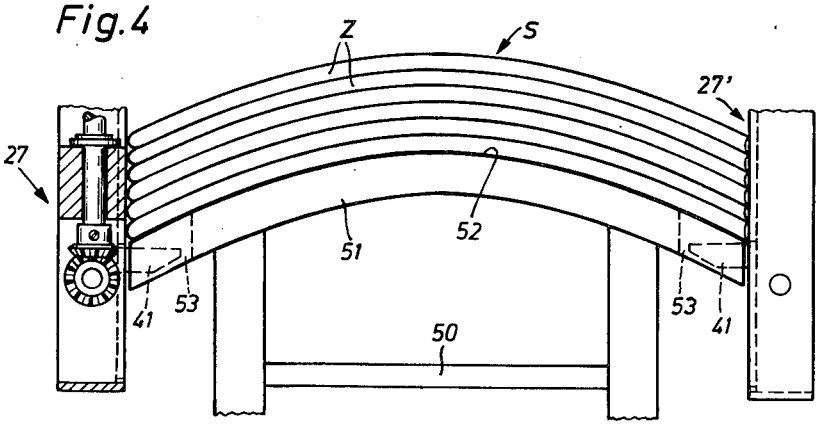
FIG. 4 is a partial view similar to FIG. 1 of another embodiment of the invention.

Referring to the drawings in particular, the invention embodied therein comprises a device for gripping a stack of flexible articles such as magazines Z which comprises a bearing plate 1 which is either arched such as the bearing plate 51 in the embodiment of FIG. 4 or may be a flat bearing plate such as the bearing plate 1 in the embodiment of FIG. 1. In each case deflecting means are associated with the bearing plate and in the embodiment of FIG. 1, this comprises a bar 6 which may be elevated at the center of the stack S so as to deflect the center upwardly from each end of the stack of magazines Z; or, surface 52 of the bearing plate 51 may constitute the deflecting means.

First and second gripping arms 27 and 27′ are mounted on means such as slide plates 13 and 14 for movement in horizontal directions toward the respective ends of the magazine stacks S inwardly to engage against the ends of the stacks for lifting purposes and outwardly to release the stacks. In addition, holding fingers 41 are associated with each of the gripping arms and they are movable to horizontal positions to engage beneath the ends of the stacks and to lift the stacks upwardly or they may be moved to vertical positions for releasing the stacks. Separate means advantageously provided for moving both the gripping arms 27 and 27′ and the holding fingers 41, 41.

The device for handling stacks S of flexible objects, hereinafter involving magazine Z, consists of a bearing plate 1 carrying the stack S and of a gripping mechanism 2.

The bearing plate 1 is fastened at the discharge end of a printing press not shown to a frame 3 and has an oblong slot 4 in its center and several recesses 5 on two opposite sides. Disposed in the guide slot 4 is a bar 6 which is movable up and down and connected to the piston rod 7 of a compressed air cylinder 8 attached to the frame 3. In raised position, the bar 6 serves as forming element for the stack S.

The gripping mechanism 2 has a horizontal carrying plate 10 on which a flange 11 is formed, by means of which the gripping mechanism 2 can be fastened to an arm of an operating mechanism (not shown). Fastened to the carrying plate 10 are two mutually parallel guide rods 12, on which are movably mounted one slide 13, 14 each on respective sides of the carrying plate 10. The slide 13 is rigidly connected to a rack 15 and the slide 14 to a rack 16. The two racks 15,16 mesh with a gear 17 mounted on the carrying plate 10 so as to be freely rotatable. The rack 15 is joined to the piston rod 18 of a compressed air cylinder 19 fastened to a vertical leg 20 of a bracket 21. The other, horizontal leg 22 of the bracket 21 is of cylindrical shape and is movably mounted in a chamber 23 in the carrying plate 10. A screw 24, screwed into the carrying plate 10, projects into a guide slot 25 of leg 22, thereby preventing the bracket 21 from turning in the chamber 23. Screwed into the hollow leg 22 is a threaded spindle 26 which is rotatably mounted in the carrying plate 10 and axially fixed.

Fastened to the underside of each of the slides 13 and 14 is a respective vertically extending clamping jaw 27 and 27′. The two clamping jaws 27 and 27′ are of identical design. They each have a clamping plate 28 which makes contact with the stack S and are reinforced by an upper and a lower rib 29, 30 by sidewalls 31 and by a bottom plate 32. A shaft 34, each penetrating the two ribs 29, 30 and the space 33 between the two ribs 29, 30 is rotatably mounted in each of the clamping jaws 27 and 27′. Fastened to the upper end of each shaft 34 is a crank 35 which is connected to the piston rod 36 of a compressed air cylinder 37 disposed on each respective slide 13 or 14. Fastened to the lower end of each shaft 34 is a is a bevel gear 38 which meshes with a bevel gear 39. The bevel gears 39 are mounted on a shaft 40, in turn mounted in the respective clamping jaw 27 and 27′. Also mounted on the shaft 40 are several holding fingers 41 which are pivotable between a horizontal and a vertical position. In the vertical position, which is their rest position, the holding fingers 41 are located in recesses 42 of the clamping plates 28 and are flush with the clamping surface of the respective clamping plate 28. In their horizontal position, which is their working position, the holding fingers 41 engage the recesses 5 of the bearing plate 1.

In the second embodiment shown in FIG. 4, an arched bearing plate 51 is fastened to a frame 50. Due to the magazines Z being arched upwardly when being deposited on the bearing plate 51 already, the top 52 of the bearing plate 51 forms a forming element for the magazines Z or the stack S. Recesses 53 are provided in the bearing plate 51 for holding fingers 41 of the gripping mechanism 2 which is the same as the other embodiment and is similraly designated.

The device operates as follows:

To transfer a stack S sitting on the bearing plate 1 to a pallet (not shown), the gripping mechanism is lowered over the stack S. At the same time, the bar 6 is raised by actuating the compressed air cylinders 8, thereby prearching the stack S into the shape shown in FIG. 1. As soon as the gripping mechanism 2 is stopped at the level required to pick up the stack S, the compressed air cylinder 19 is actuated so that it retracts the piston rod 18. This moves the rack 15 in the same direction as the piston rod and the rack 16 in the opposite direction with the consequence that the slides 13 and 14 and, hence, the clamping jaws 27 move towards each other. This causes the clamping plates 28 to contact the stack S, compressing it laterally, thereby arching it even more in the direction predetermined by the pre-arching operation. Due to being arched, the magazines Z are of such adequate stiffness as not to be able to sag downwardly.

Figure 3:
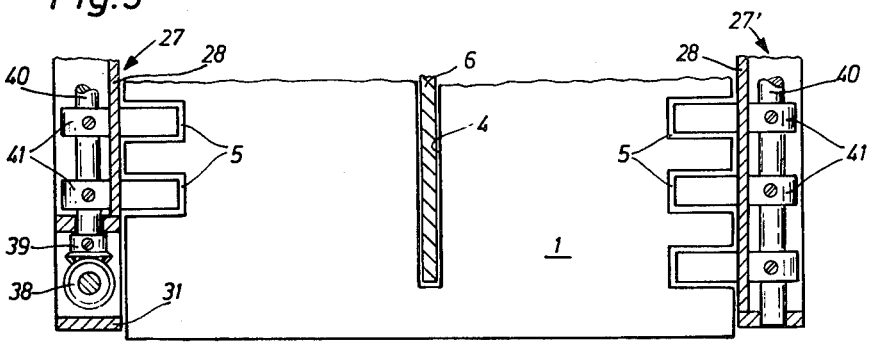
FIG. 3 is a partial sectional view taken along the line III—III of FIG. 1.
Figure 2:
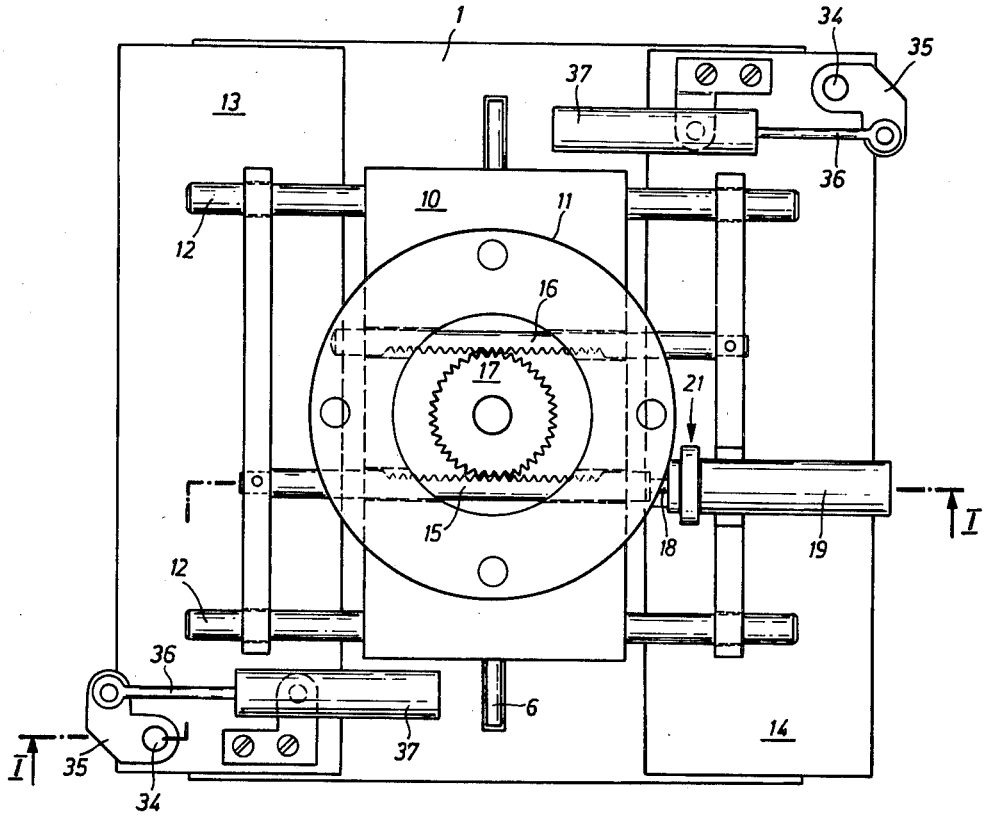
FIG. 2 is a top plan view of the mechanism shown in FIG. 1.

As soon as the clamping jaws 27 have concluded their closing motion, the two compressed air cylinders 37 are actuated simultaneously. The motion of the piston rods 36 is transmitted by the cranks 35, the shafts 34 and the bevel gears 38, 39 to the shafts 40, whereby the holding fingers 41 are pivoted out of their rest position into their working position shown in FIGS. 1 and 3. In that position, the holding fingers 41 support the two lowest edge areas of the stack S, thereby keeping the stack S in vertical direction.

After the clamping jaws 27 have clamped the stack S laterally and the holding fingers 41 have gripped under the stack S, the stack S is removed from the bearing plate 1 or 51 by moving the gripping mechanism 2 upwardly. To deposit the stack S, the gripping mechanism 2 is moved down so far that the bottom plates 32 of the clamping jaws 27 are seated on the base (not shown) receiving the stack S, said base involving, for example, a pallet or stacks already deposited earlier. Then the holding fingers 41 are first swung back into their vertical or rest position and the clamping jaws 27 subsequently moved away from each other, whereupon the stack S drops out of the gripping mechanism 2.

In the second embodiment according to FIG. 4, the magazines Z are already pre-arched when stacked on the bearing plate 51 and that by the same amount by which the stack S is pre-arched in the first embodiment by the upward motion of the bar 6. In this case, therefore, pre-arching while or immediately before the stack S is being picked up is eliminated so that the time required to pick up a stack may, under circumstances, be shorter than in the first embodiment.

If stacks S of lesser or greater width must be handled, the gripping mechanism 2 must be adjusted to the new width. For this purpose, the threaded spindle 26 is turned appropriately, thereby moving the bracket 21 relative to the carrying plate 10. The shifting motion of the bracket 21 is transmitted to the slide 13 via the compressed air cylinder 19, the piston rod 18 and the rack 15. Due to the corotation of the gear 17, the shifting motion of the bracket 21 is also transmitted to the rack 16 and the slide 14 to the same degree, but in opposite direction. In this manner, the two clamping jaws 27 are moved evenly towards or away from each other into a starting position suitable for the new width of the stack S. This setting motion does not affect the stroke length of the compressed air cylinder 19 so that the travel of each individual clamping jaw 27 is always the same when opening or closing the gripping mechanism 2.

While specific embodiments of the invention have been shown and described in detail to illustrate the application of the principles of the invention, it will be understood that the invention may be embodied otherwise without departing from such principles.

What is claimed is:

1. A device for gripping a stack of flexible articles such as magazines, comprising a bearing plate for receiving the stack of articles, deflecting means associated with said bearing plate for deflecting the center of the articles upwardly into an arched position relative to each end of the articles, first and second gripping arms, means mounting said arms for movement in substantially horizontal directions toward and away from the respective ends of the articles to be stacked for engaging and disengaging the articles, a holding finger pivotally mounted on each of the said gripping arms being movable between a substantially horizontal position for engaging below and supporting each respective end of the articles to a vertical position to release the articles, first actuating means to move said fingers to engage and disengage from the articles, and second actuating means to move said gripping arms toward and away from the articles to engage and disengage from the respective ends of the articles, said deflecting means comprising a bar engageable with the center of said articles, means mounting said bar for upwardly and downward movement relative to said bearing plate and means for moving said bar upwardly so as to arc the stack of flexible articles resting on said bearing plate.

2. A device according to claim 1, wherein said holding fingers are pivotable about a horizontal axis and in their engagement position are substantially horizontal, said bearing plate including a recess on each end thereof into which said holding fingers may move.

3. A device according to claim 1, includding a horizontal carrying plate, a first and second slide mounted on said carrying plate for movement outwardly and inwardly from each side thereof, each slide plate being connected to a clamping jaw, guide rods on said carrying plate on which said slides are movable, said first and second actuating means comprising a fluid pressure operated piston and cylinder and means connected between said cylinder and said slides to move said slides in respective opposite directions.

4. A device according to claim 3, including a bracket on which said fluid pressure operated cylinder is mounted on said carrying plate and means for adjusting one slide relative to the other slide on said carrying plate.

5. A device for gripping a stack of flexible articles such as magazines, comprising a bearing plate for receiving the stack of articles, deflecting means associated with said bearing plate for deflecting the center of the articles upwardly into an arched position relative to each end of the articles, first and second gripping arms, means mounting said arms for movement in substantially horizontal directions toward and away from the respective ends of the articles to be stacked for engaging and disengaging the articles, a holding finger pivotally mounted on each of the said gripping arms being movable between a substantially horizontal position for engaging below and supporting each respective end of the articles to a vertical position to release the articles, first actuating means to move said fingers to engage and disengage from the articles, and second actuating means to move said gripping arms toward and away from the articles to engage and disengage from the respective ends of the articles, said second actuating means comprising a fluid pressure cylinder, a shaft rotatably mounted on each of said gripper arms and being movable by said fluid pressure operated cylinder to rotate, said holding fingers being pivotable about a substantially horizontal axis being shifted by said rotation of said shaft between a substantially horizontal and substantially vertical position.

6. A device for gripping a stack of flexible articles such as magazines, comprising a bearing plate for receiving the stack of articles, deflecting means associated with said bearing plate for deflecting the center of the articles upwardly into an arched position relative to each end of the articles, first and second gripping arms, means mounting said arms for movement in substantially horizontal directions toward and away from the respective ends of the articles to be stacked for engaging and disengaging the articles, a holding finger pivotally mounted on each of the said gripping arms being movable between a substantially horizontal position for engaging below and supporting each respective end of the articles to a vertical position to release the articles, first actuating means to move said fingers to engage and disengage from the articles, and second actuating means to move said gripping arms toward and away from the articles to engage and disengage from the respective ends of the articles, said deflecting means comprising a curved surface of said bearing plate whereby said gripping arms engage the arched stack of articles.

7. A device according to claim 6, whereby said holding fingers are pivotable about a horizontal axis and in their engagement position are substantially horizontal, said bearing plate including a recess on each end thereof into which said holding fingers may move.

8. A device according to claim 6, including a horizontal carrying plate, a first and second slide mounted on said carrying plate for movement outwardly and inwardly from each side thereof, each slide being connected to a clamping jaw, guide rods on said carrying plate on which said slides are movable, said first and second actuating means comprising a fluid pressure operated piston and cylinder and means connected between said cylinder and said slides to move said slides in respective opposite directions.

9. A device according to claim 8, including a bracket on which said fluid pressure operated cylinder is mounted on said carrying plate and means for adjusting one slide relative to the other slide on said carrying plate.

* * * * *